United States Patent [19]

Husges et al.

[11] 4,223,517

[45] Sep. 23, 1980

[54] METHOD AND MECHANISM FOR ELIMINATION OF AN IRREGULARITY IN A YARN

[75] Inventors: Gerd Husges; Edmund Schuller; Rupert Karl; Eberhard Grimm, all of Ingolstadt, Fed. Rep. of Germany

[73] Assignee: Schubert & Salzer, Ingolstadt, Fed. Rep. of Germany

[21] Appl. No.: 970,655

[22] Filed: Dec. 18, 1978

[30] Foreign Application Priority Data

Dec. 24, 1977 [DE] Fed. Rep. of Germany ..... 2758064

[51] Int. Cl.[3] ..... D01H 15/00; D01H 11/00

[52] U.S. Cl. ..... 57/261; 57/263; 57/306

[58] Field of Search ..... 57/263, 261, 22, 300, 57/301, 303, 304, 305, 306

[56] References Cited

U.S. PATENT DOCUMENTS

| | | | |
|---|---|---|---|
| 3,938,306 | 2/1976 | Bous | 57/263 |
| 3,952,491 | 4/1976 | Sharychenkov | 57/263 |
| 4,083,171 | 4/1978 | Konig et al. | 57/263 |
| 4,132,056 | 1/1979 | Husges et al. | 57/263 |

*Primary Examiner*—Donald Watkins
*Attorney, Agent, or Firm*—Bailey, Dority & Flint

[57] ABSTRACT

A method and apparatus for the elimination of an irregularity in a yarn being produced on an open end spinning machine and drawn off therefrom by a pair of draw-off rollers and wound on a bobbin. The yarn is deflected into an N-shaped run so that a knotting mechanism can knot the parallel portion of the yarn together so as to remove the irregularity in the yarn. Yarn guides are provided on the knotting mechanism for displacing an oblique portion of the yarn out of the knotting mechanism when in use.

14 Claims, 8 Drawing Figures

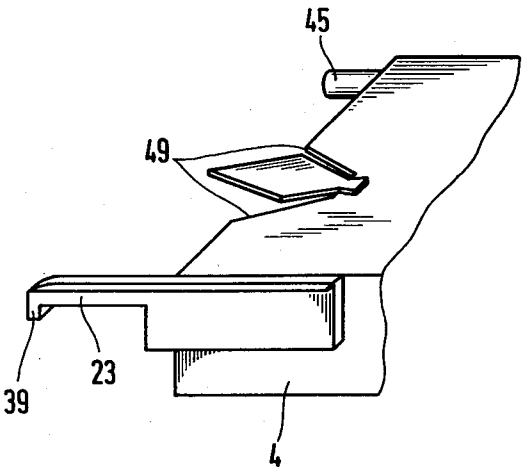
FIG. 4
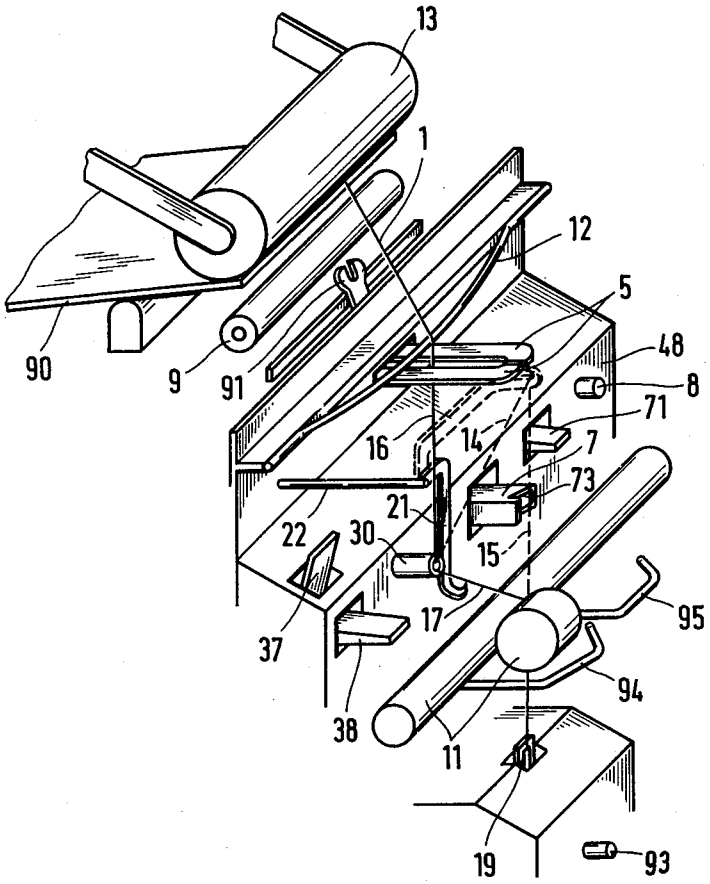

METHOD AND MECHANISM FOR ELIMINATION OF AN IRREGULARITY IN A YARN

BACKGROUND OF THE INVENTION

The present invention refers to a method of elimination of an irregularity in a yarn which in the form of two parallel sections of yarn, one of which extends to a pair of draw-off rolls and the other to a bobbin, is laid into a knotting mechanism which joins the two sections of yarn together and severs the superfluous ends of the yarn, as well as a mechanism for performance of this method.

The practice is already known for elimination of an irregularity in a yarn, to lay it in the form of two parallel sections of yarn in a knotting mechanism, to join the two sections of yarn together and to sever the superfluous ends of the yarn (West German O/S No. 2.540.703). But in this case an elaborate mechanism is necessary since first of all the yarn must be fed by means of a deflector mechanism to a severing mechanism which by severing the yarn produces two yarn ends, one of which is already lying in the knotting mechanism while the other yarn end must be introduced for the first time into the knotting mechanism by the pivoting of a gripper. Elaborate mechanisms of that kind are repeated from spinning unit to spinning unit whereby the machine becomes still more elaborate and whereby the visibility of the yarns and accessibility to them are made very much more difficult too.

SUMMARY OF THE INVENTION

This problem is solved in accordance with the invention if the yarn extending from the draw-off rolls to the bobbin is deflected for the knotting in such a way that on one hand it adopts an N-shaped run of the yarn and that on the other hand the oblique connecting section between the two parallel sections of yarn is kept out of the working range of the knotting mechanism which is brought forward perpendicularly up to the N-shaped run of the yarn. By formation of an N-shaped run of the yarn or one which is a mirror image of this, the two parallel sections of yarn necessary for the knotting are formed. Since the connecting section is being kept out of the working range of the knotting mechanism, this section also does not give any trouble during the knotting process.

The knotting does not have to be effected directly after the joining. Thus after a yarn breakage or a stoppage of an open end spinning machine it is in accordance with the invention possible to join the yarn from the individual spinning unit in the usual way, to draw it off from the spinning unit and carry it away until the yarn has been carried over into an N-shaped run of the yarn and has been knotted and only after that to wind up the yarn. This method may also be made use of in connection with the simultaneous joining of all of the spinning units of an open end spinning machine in which case the yarns of all of the spinning units are joined together and then get carried away until with simultaneous carryover of the yarn into an N-shaped run of the yarn, the knotting process is performed at one spinning unit after another and then winding is taken up again.

For performance of the method, in accordance with the invention there are provided in the run of the yarn between the draw-off rolls and the bobbin, two yarn-deflector members which at least at the instant of knotting are lying in a position such that the yarn adopts an N-shaped run of the yarn and that the knotting mechanism is movable essentially perpendicular to the N-shaped run of the yarn and exhibits yarn guides by means of which the oblique connecting section between the two parallel sections of yarn can be brought out of the working range of the knotting mechanism. The two yarn-deflector members are arranged in a stationary or movable way and at least at the instant of knotting adopt a relative position such that the yarn adopts an N-shaped run of the yarn. The knotting mechanism is in that case movable essentially perpendicular to the N-shaped run of the yarn, in which case the two parallel sections of yarn are laid in the corresponding yarn guides of the knotter, while the oblique connecting section gets brought by further yarn guides fitted to the knotting mechanism, out of the working range of the knotting mechanism and hence does not cause any trouble with the knotting process.

In order to bring the yarn automatically from an approximately straight or only slightly angled run of the yarn between the draw-off rolls and the bobbin, into an N-shaped run of the yarn angled at an acute angle, in accordance with the invention the yarn-deflector member which at the instant of knotting is arranged nearer to the draw-off rolls with respect to the run of the yarn can be brought from a position of readiness in which the yarn between the draw-off rolls and the other yarn-deflector member is not affected, into a working position in which the yarn exhibits an N-shaped run of the yarn while the other yarn-deflector member is stationary. Advantageously, the movable yarn-deflector member can be brought of of the position of readiness into the working position by an actuator member which is connected to the knotting mechanism and becomes effective upon movement of the knotting mechanism, so that the movement of the knotting mechanism is made use of for the carry-over of the yarn into the N-shaped run of the yarn. The movable yarn-deflector member may be movable in any way at all, for example, it may be arranged to be slidable. In accordance with a preferred embodiment of the object of the invention, the actuator member connected to the knotting mechanism is made as a stop cam and the movable yarn-deflector member as a swinging stirrup which cooperates with this cam and the axis of which lies essentially between the stationary yarn-deflector member and the bobbin.

Joining of the yarn is effected a certain time before the knotting. In order that the yarn gets carried away from the yarn delivery point even until knotting, the stationary yarn-deflector member is preferably made as a yarn suction device. Hence the yarn carried away from the yarn delivery point by the draw-off rolls is absorbed by the yarn suction device which is in that case advantageously actuable by hand as well as by a stop arranged on the knotting mechanism. In this way the knotting mechanism may be opened, for example, by hand for the joining and after conclusion of the knotting process may be closed by the movement of the knotting mechanism away from it.

In order to ensure that the yarn adopts for the knotting process, an exact N-shaped run of the yarn independently of the point at which the yarn reaches the bobbin, in accordance with a further feature of the invention there is arranged between the working position of the knotting mechanism and the bobbin a yarn guide which keeps the section of yarn extending from the stationary yarn-deflector member to the bobbin parallel with the section of yarn extending from the draw-off rolls to the movable yarn-deflector member and which controlwise is connected on the one hand to a yarn monitor and upon yarn breakage can be brought into the run of the yarn and which on the other hand is connected to a further switch mechanism which can be actuated by a stop arranged on the knotting mechanism in order to be brought out of the run of the yarn after the conclusion of the knotting process. Hence this yarn guide is lying in the run of the yarn merely during standstill of the operating unit until after the conclusion of the knotting process, so that the traversing of the yarn for the winding up is not impaired.

In accordance with a preferred embodiment of the invention, the yarn guide consists of two part-guides which can be spread apart beyond the area of run of the yarn sweep during traversing of the yarn and extend across the whole area of run of the yarn. Separate laying of the yarn into the yarn guide is thereby unnecessary since the yarn lies automatically between the two part guides. In order to avoid unintentional slipping of the yarn out of the part guides, the part guides are advantageously on their sides next to the yarn provided at the ends with hooks by which the yarn gets caught.

In order to bring the yarn to rest in the knotting mechanism during the knotting process, in accordance with a further feature of the invention there is arranged in known manner between the draw-off rolls and the working position of the knotting mechanism, a pneumatic yarn storage which can be put into service by a stop arranged on the knotting mechanism and out of service by a timing element actuated by the stop. For securing the exact N-shaped run of the yarn the yarn storage advantageously exhibits a yarn guide along the run of the yarn.

The winding up of the yarn is synchronized with the knotting process so that the yarn does not get wound up during the knotting process. But in order that the winding up process is started only directly after the conclusion of the knotting process, in a manner known, a bobbin support member is associated with the bobbin, which can be brought by a yarn monitor into the lift-off position and by the knotting mechanism into the position of readiness.

The practice is indeed already known of leading the yarn in an N-shape (West German A/S No. 1.288.965). But in that case the N-shaped run of the yarn lies between the spinning member and the draw-off rolls. Furthermore, it is not intended that a knotting mechanism be brought up to the N-shaped run of the yarn nor is the oblique connection section between the two parallel sections of yarn kept out of the working range of a knotting mechanism.

Accordingly, it is an object of the present invention to provide a method and mechanism for the elimination of irregularities in yarn.

Another important object of the present invention is to provide a relatively simple method and apparatus for deflecting the run of yarn on a yarn producing machine so that a knotting mechanism can be brought in contact with the yarn for removing irregularities therefrom.

These and other object and advantages of the invention will become apparent upon reference to the following specification, attendant claims, and drawings.

BRIEF DESCRIPTION OF THE DRAWINGS

FIG. 4 is a perspective view of still another embodiment of the invention.

DESCRIPTION OF A PREFERRED EMBODIMENT

Figure 1:
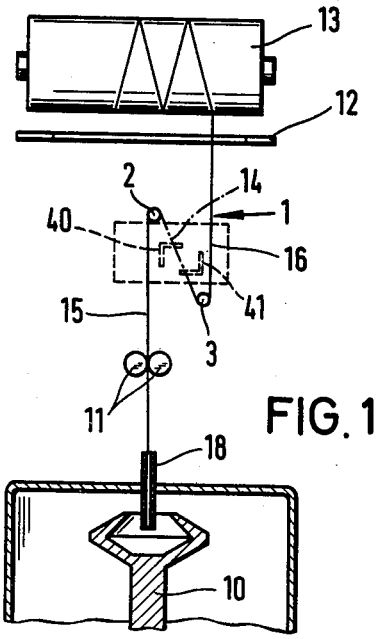
FIG. 1 is a diagrammatical elevational view illustrating an open end spinning unit with the run of the yarn deflected in accordance with the present invention during a knotting process.

The invention is first of all explained in its basic form with the aid of FIG. 1, which shows diagrammatically a spinning unit made in accordance with the invention. The parts not absolutely necessary to understanding the explanation have consequently been omitted in this Figure.

The yarn 1 which is being produced in known manner in an open-end spinning chamber made, for example, as a spinning rotor 10, is drawn off by a pair of draw-off rolls 11 from the spinning rotor 10 and then fed via a yarn tension equalizer stirrup 12 to a bobbin 13 which is driven in known manner. Moreover, the yarn 1 on its way between the draw-off rolls 11 and the bobbin 13 is guided by two yarn-deflector members 2 and 3 along an N-shaped run of the yarn. These yarn-deflector members 2 and 3 may also if required be made to be able to be brought out of action, for example, by being pivotable or retractable.

If after a stoppage of the spinning unit or the whole machine the yarn is being joined by delivery backwards into the spinning rotor 10 and feeding of individual fibers into the spinning rotor 10, a point of join occurs which in the processing of the spun yarn 1 is undesirable since it makes itself noticeable as an irregularity in the form of a thick or thin place in the yarn 1. Consequently in practice one endeavors to replace this point of join in the yarn 1 by a knot which in the finished material is brought onto the wrong side of the goods.

In order to perform the knotting on the spinning unit it is necessary to make available two parallel sections of yarn which are joined together. Hitherto it has been usual to lead the two sections of yarn in one piece in opposite directions through a knotting mechanism. But then deflector devices are necessary which are elaborate both from the point of view of the mechanism and also in their requirement of space. In order to avoid this space requirement two parallel sections of yarn running in the same direction are led through the knotting mechanism. These sections of yarn are severed from one another by a yarn severing mechanism. In this case, elaborate yarn severing and gripper devices are necessary.

In accordance with the present invention the disadvantages indicated are avoided by the fact that the yarn 1 adopts an N-shaped run of the yarn with two parallel sections of yarn 15 and 16 and an oblique connecting section 14. The yarn 1 is consequently guided round the yarn-deflector members 2 and 3 and then joined in known manner. The yarn 1 is then drawn-off by the draw-off rolls 11 from the spinning rotor 10. At the same time a knotting mechanism 4 shown diagrammatically moves into the N-shaped run of the yarn essentially perpendicularly to it. This knotting mechanism 4 exhibits yarn guides 40 and 41 by which the oblique connecting section 14 of the yarn 1 gets carried out of the working range of the knotting mechanism 4 when the knotting mechanism 4 is brought into the working position. The connecting section 14 is held in this position outside of the working range of the knotting mechanism 4 until the knotting process is concluded. Hence only the two parallel sections of yarn 15 and 16 are lying in the working range of the knotting mechanism 4 and are joined together.

Figure 3:
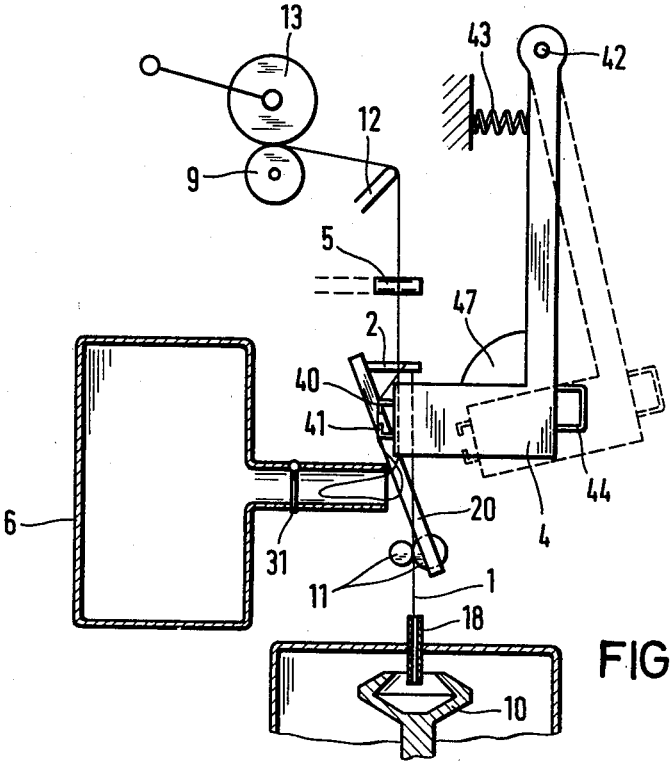
FIG. 3 is a side elevational view illustrating the mechanism of FIG. 2 with a knotting mechanism shown in a working position.

The knotting mechanism 4 may be arranged to be able to slide in guides or pivot about an axis. FIG. 3 shows, for example, one embodiment in which the knotting mechanism 4 is suspended from a rail 42 extending along the open-end spinning machine above a number of spinning units, and about which it can be swung against the action of a compression spring 43 into the working position shown. After release of the knotting mechanism 4 held by the handle 44, the knotting mechanism is swung away again from the spinning unit. Naturally a positioning device (not shown) is also provided which ensures that during knotting the knotting mechanism 4 is lying in the correct working position.

Figure 2:
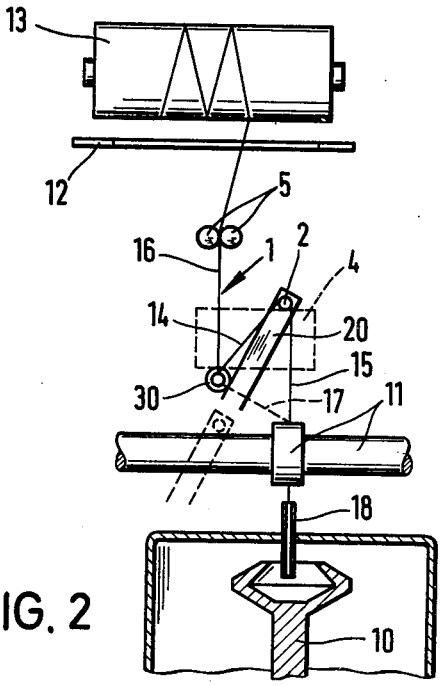
FIG. 2 is a front elevation of a modified form of the invention illustrating diagrammatically another device for deflecting yarn into an N-shaped run.

In FIGS. 2 and 3 an embodiment of the mechanism in accordance with the invention is shown, in which the yarn 1 after joining is first carried away pneumatically before the knotting process starts. In this way the operator can be allowed a little more time with starting the knotting process since the yarn 1 delivered from the yarn delivery point gets carried away. As a result, the knotting process does not have to rely on the point of join lying in the section of yarn which is lying just in the connecting section which is lying obliquely and hence is to be severed in the knotting.

For carrying away the yarn 1 with the point of join before the start of the knotting process the yarn-deflector member arranged further away from the draw-off rolls 11 with respect to the run of the yarn and hence—with respect to the run of the yarn—nearer to the bobbin 13, is made as a yarn suction device 30 which is connected via a valve made, for example, as a flap 31, to a suction channel 6.

The yarn-deflector member 2 lying at the instant of the knotting process nearer to the draw-off rolls 11 with respect to the run of the yarn, is in the embodiment shown arranged on a movable rail 20 which can be brought from a position of readiness into a working position. In the position of readiness the yarn-deflector member 2 is lying outside the run 17 of the yarn forming the direct connection between the draw-off rolls 11 and the yarn suction device 30, so that the yarn 1 is not affected by the yarn-deflector member 2. On the contrary, in the working position of the yarn-deflector member 2 the yarn 1 adopts an N-shaped run of the yarn. In the sense of the present invention it is to be understood that N-shaped run of the yarn applies to both a run of the yarn strictly according to the letter N or also according to its mirror image, as is apparent also from a comparison of FIGS. 1 and 2.

In order to ensure that the section of yarn 16, independently of the region along the length of the bobbin 13 at which it reaches it, always runs in parallel with the section 15 of yarn, in the embodiment shown in FIG. 3 a yarn guide 5 is provided between the working position of the knotting mechanism 4 and the bobbin 13. This yarn guide 5 can be brought into the run of the yarn for the knotting process and directly after the introduction of the yarn 2 into the knotting mechanism 4, it is drawn back out of the run of the yarn.

The yarn 1 is pulled off the bobbin 13 in the usual way, laid into the yarn guide 5, brought to the correct length for joining, and fed into the yarn draw-off tube 18 associated with the spinning rotor 10. By a guide (not shown) or by delayed applying of the one draw-off roll 11 against the other, the yarn 1 arrives on the line of pinch of the draw-off rolls 11. While the bobbin 13 is not yet being driven, the yarn 1 drawn off from the spinning rotor 10 is carried away into the yarn suction device 30 made ready to receive it by opening of the flap 31. The yarn in that case adopts the run of the yarn 17. Now in a suitable way, for example, by bringing up the knotting mechanism 4 from it, the rail 20 with the yarn deflector member 2 is displaced until the yarn 1 exhibits an N-shaped run of the yarn with two parallel sections of yarn 15 and 16 and an oblique connecting section 14. The sections of yarn 15 and 16 are held at one side by the draw-off rolls 11 and the yarn deflector member 2 and at the other side by the yarn suction device 30 and the yarn guide 5 in parallel with one another so that correct laying into the knotting mechanism 4 is guaranteed. During the movement of the knotting mechanism 4 into the working position, the yarn guides 40 and 41 arrive in the region of the connection section 14 and hold this section 14 of yarn away from the working range of the knotting mechanism 4.

After the conclusion of the knotting process which is started in a suitable way, the knotting mechanism 4 is released and returned into its rest position under the action of the compression spring 43 (or a telescopic spring or the like). The section of yarn 14 severed in the knotting process is carried away by the yarn suction device 30. At the same time by means not shown the bobbin 13 is brought into the service position and the yarn 1 is wound up. The flap 31 may now be closed so that the yarn suction device is no longer effective.

As is shown in FIG. 4, instead of a slidable yarn-deflector member 2, a yarn-deflector member made as a swinging stirrup 21 may also be made use of, the axis 22 of which lies essentially between the stationary yarn-deflector member made as a yarn suction device 30 or in a mechanical way (3) and the bobbin 13 or respectively the yarn guide 5. The actuator member by which the swinging stirrup 21 can be brought from the position of readiness (solid line) into the working position (dotted line) is in the case of the form shown made as a stop cam 23 connected to the knotting mechanism 4 with which the swinging stirrup 21 cooperates. When the knotting mechanism 4 is pushed or swung into the working position the stop cam 23 raises the swinging stirrup 21 so that the yarn 1 is carried over into the N-shaped run of the yarn.

In principle, it does not matter how the actuator means of the knotting mechanism 4 is made. Thus, the actuator member instead of being made as a stop cam may also be made as a stop which actuates a switch by which in turn, a magnet or some other driving mechanism is actuated, by which the yarn-deflector member 2 or the swinging stirrup 21 is brought into the working position and upon release is brought back by the actuator member into the position of readiness.

Figure 5:
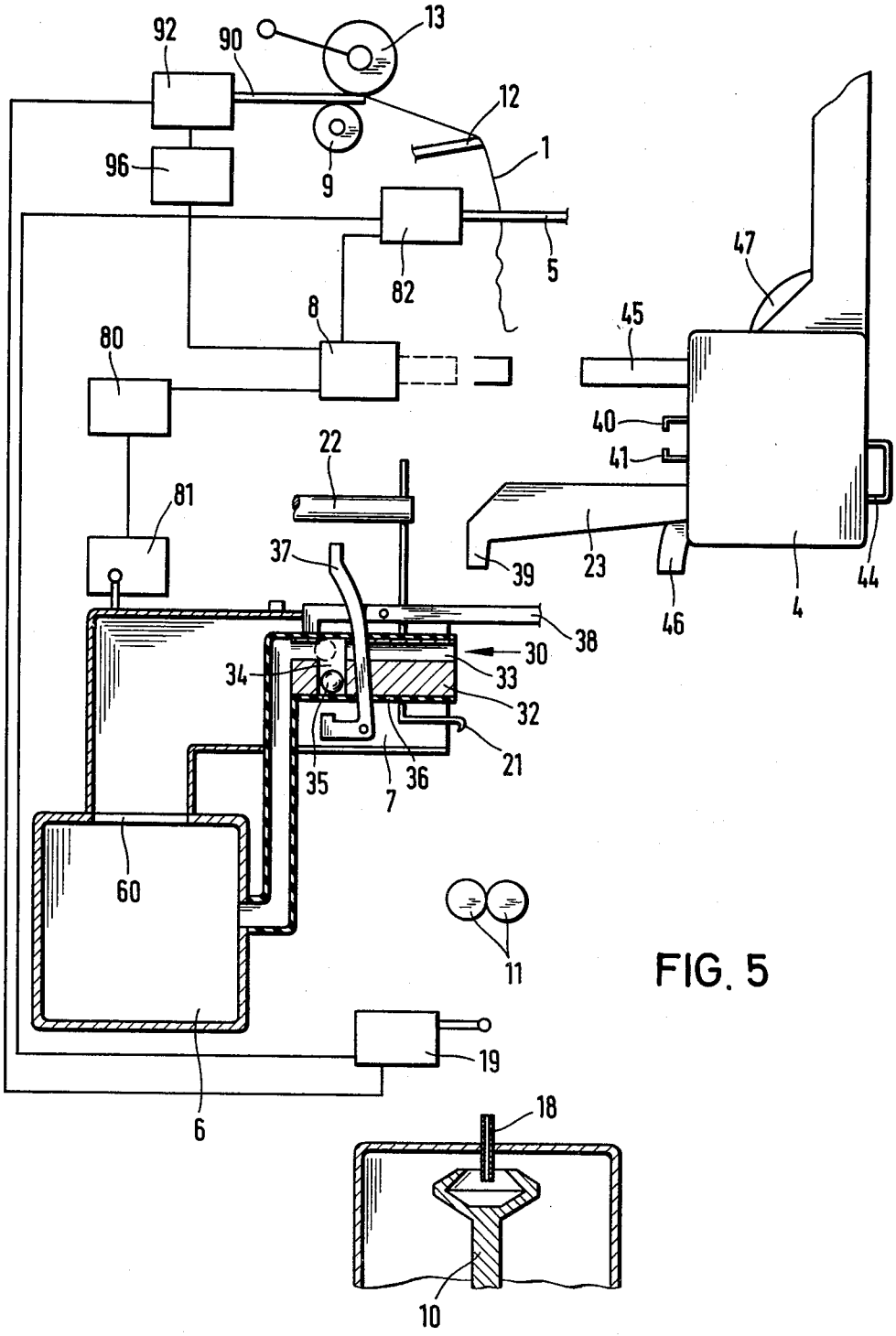
FIG. 5 is a side elevational view of the mechanism shown in FIG. 4 showing the connection for controlling the operation of the mechanisms therein.

Preferably, the yarn suction device 30 can be actuated by hand as well as by a stop arranged on the knotting mechanism 4. For doing this the yarn suction device 30 may be controlled in various ways, for example, by means of the flap 31 shown in FIG. 3. FIG. 5 shows another form in which the yarn suction device is arranged horizontally and exhibits a tubular housing 32 with an eccentric bore 33 which is interrupted by a vertical shaft 34 in which is arranged a ball 35 as a closure member. The housing 33 is surrounded by an elastic sleeve 36 against which in the region of the shaft 34 a lever 37 can be brought into action from below and a lever 38 from above. For opening the yarn suction device 30 the ball 35 which in the closed position is lying in the position shown dotted, must be pushed downwards into the shaft 34, for which purpose the lever 38 is actuated briefly counterclockwise. The yarn 1 can now be sucked into the yarn suction device 30. When the knotting process is finished the knotting mechanism 4 is removed from the spinning unit. Thereupon the hook-like stop 39 seizes the lever 37 and pulls it forwards, whereby the ball 35 is pushed upwards, where it comes into the effective airflow and closes the bore 33 (position of the ball 35 shown dotted).

Figure 6:
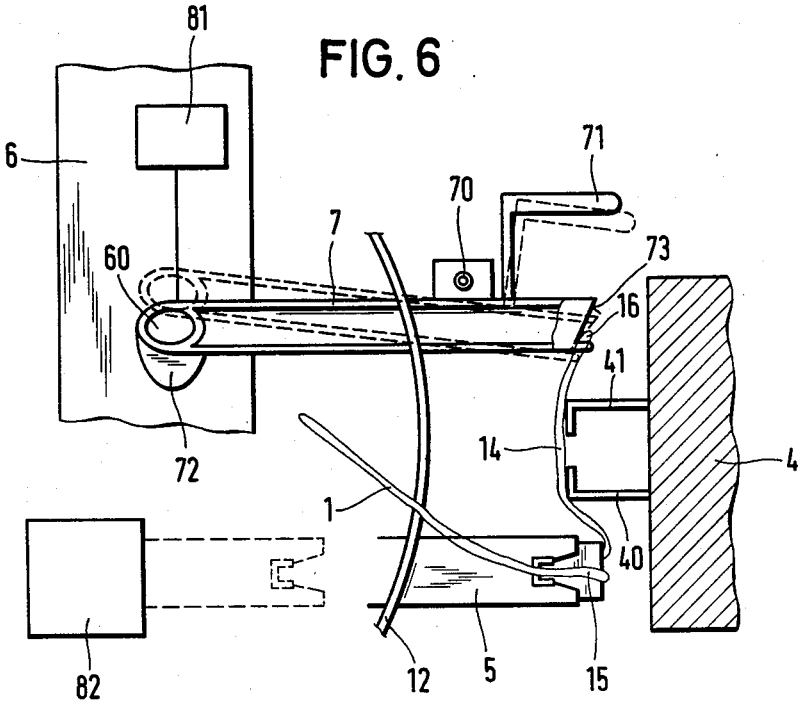
FIG. 6 is an enlarged fragmentary plan view of the mechanism constructed in accordance with the invention shown in FIGS. 4 and 5.

In order that during the knotting process the yarn 1 is brought to rest in the knotting mechanism 4, a pneumatic yarn storage 7 is advantageously arranged between the draw-off rolls 11 and the working position of the knotting mechanism 4, which can be put into service by a stop 45 arranged on the knotting mechanism 4 and out of service by a timing element 80 actuated by the stop 45 (FIGS. 4 and 5). A switch 8 is actuated by the stop 45 and actuates via the not yet effective time element 80 an electromagnet 81 which brings the pneumatic yarn storage 7 which can pivot about an axis 70, out of the position shown dotted into the position shown in solid line (FIG. 6). The yarn storage 7 thereby arrives with its rear end over the opening 60 in the suction channel 6. An actuator lever 71 may also be connected to the pneumatic yarn storage 7, by which the pneumatic yarn storage 7 may be additionally or exclusively controlled by hand or by the knotting mechanism 4. When the yarn storage 7 is lying in the position out of service a flange 72 covers over the opening 60.

The retractable yarn guide 5 is connected on the one hand to a yarn monitor 19 which senses the tension of the yarn 1 between the yarn draw-off tube 18 and the draw-off rolls 11, and on the other hand to the switch 8 which brings about the retraction of the yarn guide 5. For the control of this movement an electromagnet 82 or some other driving mechanism is associated with the yarn guide 5.

A bobbin support member 90 is associated with the bobbin 13 which on the one hand can be brought by the yarn monitor 19 into the lift-off position in which the bobbin 13 is raised from the driving shaft 9, and by the knotting mechanism 4 into the position of readiness in which the bobbin 13 is released from the bobbin support member 90 and driven by the driving shaft 9. The driving shaft 9 may be made as a traversing mechanism (see FIG. 8). But a separate yarn-traversing guide 91 may be associated with it too.

The method of operating of the preferred embodiment of the object of the invention, illustrated in FIGS. 4 to 6 will now be described.

In spinning operation, the yarn 1 as usual is drawn by the draw-off rolls 11 out of the yarn draw-off tube 18 associated with the spinning rotor 10 and fed via the yarn tension equalizer stirrup 12 to the bobbin 13 driven by the driving shaft 9, the yarn 1 being traversed along the bobbin 13. If a yarn breakage or a drop in yarn tension caused in some other way occurs, this is signalled by the yarn monitor 19 to the electromagnet 92 which pushes the bobbin support member 90 under the bobbin 13 and hence separates the bobbin 13 from its driving shaft 9 and thereby brings it to rest. The bobbin support member 90 is advantageously pushed under the bobbin 13 so rapidly that the yarn end has not yet reached the bobbin 13 but is hanging down freely under the bobbin 13. The otherwise usual handling times for the operator to look for the yarn are thereby avoided.

At the same time the yarn monitor 19 signals the drop in yarn tension to the electromagnet 82 which brings the yarn guide 5 into the working position.

The operator is made aware of the trouble in the usual way by a signal lamp. The operator presses briefly from below against the free arm of the lever 38 so that the operating arm acts through the sleeve 36 on the ball 35 and pushes this away from the bore 33 into the shaft 34. The ball 35 is thereby pushed away out of the air stream which is produced by the reduced pressure acting in the suction channel 6, and remains lying in the shaft 34.

The operator now lifts the bobbin 13 off the supporting member 90, looks for the yarn end and pulls down a length of yarn adequate for joining and brings this yarn end to the exact length for joining by cutting it off. This yarn end of a length determined exactly for joining is laid into the yarn guide 5 and now introduced into the yarn draw-off tube 18, while by actuating the button 93 (FIG. 4) the yarn monitor 19 is put out of action and the yarn feed into the spinning rotor 10 (FIG. 5) is switched on.

The yarn 1 makes contact with the ring of fibers formed in known manner in the spinning rotor 10 and becomes tensioned. Under this tension it tightens and is introduced by the yarn guide stirrups 94 and 95 sideways into the line of pinch of the draw-off rolls 11. The drawn-off yarn 1 comes into the range of suction of the yarn suction device 30 and is sucked away continuously. Moreover, the point of join in the yarn 1 is also carried away. The yarn in that case extends along the run of yarn 17.

A singnal-emitter is advantageously connected to the yarn monitor 19, for the knotting mechanism 4 carried on a rail 42 (FIG. 3) and movable along it. The knotting mechanism 4 thereupon with the aid of driving means not shown, travels until within reach of the operator busy at the spinning unit in question and remains standing at a certain distance from him, which may be controlled by an approach switch on the knotting mechanism 4. The operator now grasps the knotting mechanism 4 by the handle 44 and pulls it in front of the spinning unit where it is stopped in the exact position by ordinary catch means (now shown), and swings it towards the spinning unit. Thereupon the stop cam 23 on the knotting mechanism 4 comes underneath the angled swinging strirrup 21 and raises it. The swinging stirrup 21 by its free end seizes the yarn 1 in the region of the run of yarn 17 and deflects it into an N-shaped run of the yarn with two parallel sections of yarn 15 and 16 and a connecting section 14. Upon swinging the knotting mechanism 4 in the direction towards the N-shaped run of yarn the two yarn guides 40 and 41 push away the section of yarn 14 so that this section of yarn 14 does not come within the working range of the knotting mechanism 4.

With the swinging movement of the knotting mechanism 4 the switch 8 is also actuated by the stop 45 on the knotting mechanism 4 and in turn, actuates the electromagnet 81. The electromagnet 81 pivots the pneumatic yarn storage 7 from its rest position shown in dotted line in FIG. 6, in which its flange 72 is covering over the opening 60 in the suction channel 6, into the working position in which the pneumatic yarn storage is connected with the suction channel 6.

Hence a reduced pressure prevails in the pneumatic yarn storage 7 which is effective for the duration of the knotting process which is started simultaneously with the switching on of the pneumatic yarn storage 7.

The knotting mechanism 4 exhibits a stop 46 (FIG. 5) which cooperates with the cover 48 of the spinning unit acting as a stop and releases a free-running coupling (not shown) so that the motor 47 of the knotting mechanism 4 can drive it for the duration of one knotting process. A repetition-catch is further provided which prevents the knotting mechanism 4 being actuated a second time from one and the same actuation of the stop 46.

The switch 8 actuates the electromagnet 82 of the yarn guide 5 which releases the yarn 1 again. But meanwhile the yarn 1 has been introduced into guide slots 49 (see FIG. 4) provided in the knotting mechanism 4, so that the guidance of the yarn 1 by the yarn guide 5 is no longer necessary.

The section of yarn 14 severed in the knotting process is carried away by the reduced pressure acting in the yarn suction device 30. The yarn 1 now extends from the draw-off rolls 11 to the pneumatic yarn storage 7 and thence through the yarn guide 5 to the bobbin 13.

Simultaneously with the actuation of the switch 8, the electromagnet 92 is actuated by it via a time element 96 and pulls away the bobbin support member 90 from under the bobbin 13 so that the latter with a delay determined by the knotting process rests on the driving shaft 9. Through the lowering of the bobbin 13 the yarn also arrives again within the range of the traversing mechanism (the driving shaft 9 made as a grooved roll—see FIG. 8—or a yarn-traversing guide 91—see FIG. 4)x so that simultaneously with the start of the winding up the traversing of the yarn 1 starts too.

During the knotting process the yarn 1 is brought to rest in the knotting mechanism 4 by the yarn 1 delivered from the draw-off rolls 11 being taken up temporarily in the yarn storage 7. After a time predetermined by the timing element 80 after actuation of the switch 8 for which the yarn has been used up and stored intermediately during the knotting process, the electromagnet 81 is excited, which swings the yarn storage 7 back into the position shown in dotted line.

After the knotting process the knotting mechanism 4 is brought by the compression spring 43 out of the range of the run of the yarn. Thereupon the hook-shaped stop 39 actuates the lever 37 which acts through the sleeve 36 on the ball 35 and brings it into the air flow which brings the ball into contact with the bore 33 next the suction channel 6 and thence puts the yarn suction device 30 out of service.

The knotting process is thereby concluded and the point of join which has been severed during the knotting process has been carried away by the yarn suction device 30. Hence the join has been substituted by a knot.

The yarn 1 is being deflected by the guide slots 49 on the top and bottom sides of the knotting mechanism 4. In order to prevent the yarn in this case from slipping out of the mouth of the pneumatic yarn storage 7, the latter advantageously exhibits a yarn guide 73 along the run of the yarn. In accordance with a particularly simple embodiment this yarn guide 73 is formed by a notch.

The time elements 80 and 96 may be made in various ways. Depending upon the length of time electrical or mechanical delay devices may be made use of. Also, instead of or in addition to the electromagnets 81, 82 and 92, other driving means may be applied such, for example, an pneumatic or hydraulic cylinders. Furthermore, these means may be combined with springs.

The knotting process may be started in various ways. For example, a switch is arranged on the handle 44 of the knotting mechanism 4, which may be actuated by the operator. A drive may be switched on by this, which after the expiry of the knotting process switches itself off again automatically. The switch may also release a coupling for the duration of one knotting process. In the embodiment described, instead of a switch a stop 46 is provided (FIG. 5) which controls the coupling. As the drive of the knotting mechanism a motor 47 may, as described, be used; but also a friction wheel gear may be provided which during the knotting process is driven by one of the draw-off rolls 11 or some other rotating shaft of the machine.

The control of the pneumatic yarn storage 7 is effected in the embodiment described by swivelling it. Naturally it is equally possible here to provide a valve which in a similar way to the yarn suction device is made as a flap or as a ball valve.

Figure 7:
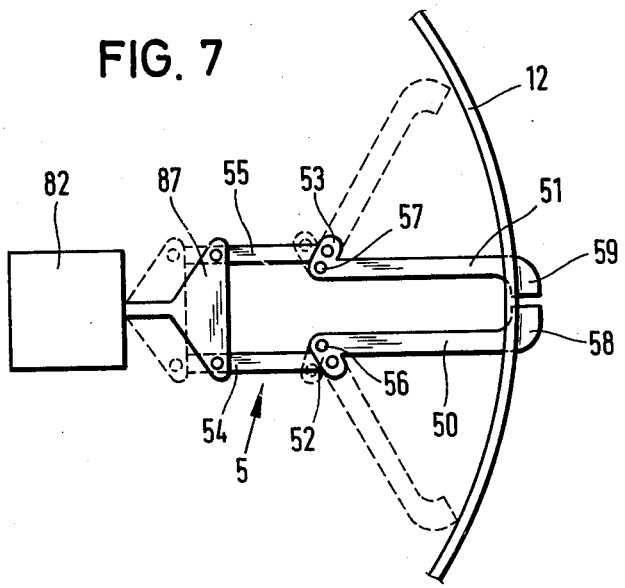
FIG. 7 is a plan view illustrating a modified form of a yarn guide such as shown in FIG. 6.
Figure 8:
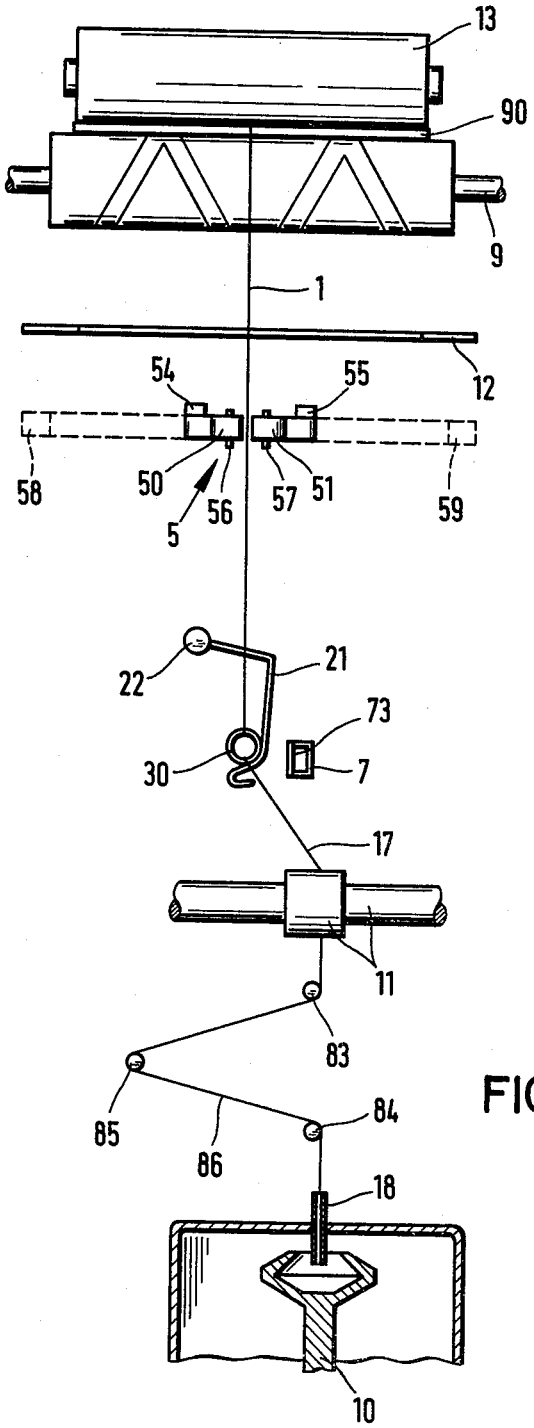
FIG. 8 is still another modified form of the invention and in particular, an apparatus for automatically bringing to rest and joining the yarn.

An embodiment of the invention suitable for simultaneous joining of all of the spinning units after a machine stoppage is to be described with the aid of FIGS. 7 and 8. In the case of this embodiment, there are between the yarn draw-off tube 18 and the draw-off rolls 11 two stationary yarn guides 83 and 84 between which a further yarn guide 85 may be moved transversely to the run of the yarn for building up a yarn reserve 86.

In the case of this embodiment, the yarn guide 5 consists of two part-guides 50 and 51 which can be spread apart as far as beyond the area of run of the yarn swept during traversing of the yarn 1 and established by the yarn tension equalizer stirrup 12. For this purpose, each part-guide 50 and 51 exhibits a second cranked arm 52 and 53 which is connected by a coupling member 54 and 55, respectively, to a yoke 87 which forms the core of the electromagnet 82 or is respectively connected to it. Each part-guide 50 and 51 is supported to be able to swing about an axis 56 or 57, respectively. The part-guides 50 and 51 in the spread apart state extend across the whole swept width of the area of run of the yarn. In order to be able to catch the yarn with certainty and guide it to the center, the part-guides 50 and 51 on their sides next the yarn 1 advantageously exhibit hooks 58 and 59 at their operating ends.

If the spinning machine is brought to rest, in known manner by shifting the yarn-guide 85 a yarn reserve 86 intended for joining on again gets built up. At the same time the bobbin 13 is raised by the bobbin support member 90 from the driving shaft 9 and thence the bobbin 13 is brought to rest. By actuation of the electromagnet 82 the part-guides 50 and 51 are swung from the spread position shown in dotted line into the working position shown in solid line, whereupon the yarn 1 is brought into the position favorable to the knotting to be performed during the joining.

For joining, the yarn suction devices 30 of the individual spinning units of the machine are released. In the case of the device described previously with the aid of FIG. 5, this happens automatically because upon the dropping away of the reduced pressure by the switching off of the machine, the ball 35 because of gravity drops into its shaft 34. In the case of simultaneous joining of all of the spinning units, the yarn guides 85 by moving back or throwing it off release the yarn reserve 86 which now gets sucked back into the spinning rotor 10 and there makes contact with the fibers fed in meanwhile. The yarn 1 is now sucked into the yarn suction device 30 and carried away by this.

The operator now goes along the machine with the knotting mechanism and now provides the yarn 1 at one spinning unit after another with a knot, whereupon in the way described the winding up is started again and the spinning process continued in the usual way. The knotting at the individual spinning units proceeds so rapidly that in the case of a spinning machine with 84 spinning units lying side-by-side, less than three minutes are needed for this process. Moreover, no significant amount of material is consumed, so that this kind of joining forms an altogether advantageous solution.

In the embodiments shown in FIGS. 3 to 8 the yarn guide 5 is fixed to the machine frame. But since the yarn guide 5 cooperates with the knotting mechanism 4 it is—independently of the special form of the yarn guide 5—possible to arrange the yarn guide 5 also on the knotting mechanism and to control it from the latter, for example, in dependence upon the movement transversely to the machine.

While a preferred embodiment of the invention has been described using specific terms, such description is for illustrative purposes only, and it is to be understood that changes and variations may be made without departing from the spirit or scope of the following claims.

What is claimed is:

1. A method of elimination of an irregularity in a yarn which includes two parallel sections of yarn, one of which extends to a pair of draw-off rolls and the other to a bobbin, said two parallel sections being laid into a knotting mechanism which joins the two sections of yarn together and severs the superfluous ends of the yarn, the improved method comprising the following steps:

deflecting said yarn extending from said draw-off rolls to said bobbin in such a way that said yarn adopts an N-shaped run of yarn containing an oblique connection section between said two parallel sections; and maintaining said oblique connecting section out of the working range of said knotting mechanism as said knotting mechanism is brought forward perpendicularly up to said N-shaped run of the yarn.

2. The method as set forth in claim 1 wherein said irregularity in said yarn was produced by joining of said yarn in an open-end spinning unit and further comprising the steps of:

drawing off said joined yarn from said spinning unit until said joined portion has been carried over into said N-shaped run and has been knotted and removed.

3. An apparatus for elimination of an irregularity in a yarn which includes two parallel sections of yarn, one of which extends to a pair of draw-off rolls and other to a bobbin, a knotting mechanism joining said two parallel sections of yarn together with a knot and severing the superfluous portion of said yarn containing said irregularity, the improvement comprising:

means for deflecting said yarn between said draw-off rolls and said bobbin in such a way that said yarn adopts an N-shaped run of yarn containing an oblique connecting section between said two parallel sections; and means for maintaining said oblique connecting section out of the working range of said knotting mechanism as said knotting mechanism joins said two parallel sections of yarn.

4. The apparatus as set forth in claim 3 further comprising:

said means for deflecting said yarn including:

two yarn deflector members which at least at the instant of knotting are lying in a position such that said yarn adopts said N-shaped run of said yarn;

means for moving said knotting mechanism essentially perpendicular to said N-shaped run of yarn for engaging said parallel sections in order to perform said knotting operation; and yarn guides carried by said knotting mechanism engaging said oblique connecting section of said yarn and bringing said oblique connecting section out of the working range of said knotting mechanism during said knotting operation.

5. The apparatus as set forth in claim 4 further comprising:

one of said yarn deflector members being movable from a position of readiness wherein the run yarn of said yarn between said draw-off rolls and said other yarn deflector member is not affected, into a working position in which said yarn exhibits an N-shaped run of the yarn while said other yarn deflector member is stationary.

6. The apparatus as set forth in claim 5 further comprising:

an actuator member carried by said knotting mechanism for moving said movable yarn-deflector member from said position of readiness to said working position responsive to said knotting mechanism being moved for performing said knotting operation.

7. The apparatus as set forth in claim 5 further comprising:

said stationary yarn deflector member being a yarn suction device.

8. The apparatus as set forth in claim 7 further comprising:

means for selectively actuating said yarn suction device.

9. The apparatus as set forth in claim 3 further comprising:

a yarn guide means carried between the working position of said knotting mechanism and said bobbin which keeps the section of yarn extending from the stationary yarn-deflector member to the bobbin parallel with the section of yarn extending from the draw-off rolls to the movable yarn-deflector member;

a yarn monitoring means operably connected to said yarn guide means for causing said yarn guide means to be brought into the run of said yarn responsive to a breakage in said yarn; and a switch means operably connected to said yarn guide means for causing said yarn guide means to be brought out of the run of said yarn after the conclusion of knotting process.

10. The apparatus as set forth in claim 9 further comprising:

said yarn guide means includes two part-guides which can be spread apart as far as beyond the area of run of said yarn sweep during traversing of the yarn and extends across the whole area of run of the yarn.

11. The apparatus as set forth in claim 10 further comprising:

hooks provided at the ends of said part-guides on a side facing said yarn.

12. The apparatus as set forth in claim 3 further comprising:

a pneumatic yarn storage device carried between said draw-off rolls and the working position of said knotting mechanism;

stop means carried by said knotting mechanism for activating said pneumatic yarn storage device placing it in service;

a timing element activated by said stop means for taking said pneumatic yarn storage device out of service.

13. The apparatus as set forth in claim 12 further comprising:

a yarn guide carried on said pneumatic yarn storage device.

14. The apparatus as set forth in claim 3 further comprising:

a bobbin support member associated with said bobbin;

a yarn monitor means causing said bobbin support member to assume a lift-off position responsive to a breakage in said yarn; and means for causing said bobbin support to assume a position of readiness responsive to said knotting mechanism completing said knotting operation.

* * * * *